US008443557B2

(12) United States Patent
Gevers et al.

(10) Patent No.: US 8,443,557 B2
(45) Date of Patent: May 21, 2013

(54) TOWER BASE SECTION OF A WIND TURBINE, A WIND TURBINE AND A SYSTEM FOR MOUNTING A TOWER

(75) Inventors: William Gevers, Simpsonville, SC (US); Nina Kristeva, Greenville, SC (US); Hueseyin Karaca, Herne (DE)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/234,341

(22) Filed: Sep. 16, 2011

(65) Prior Publication Data

US 2012/0137620 A1 Jun. 7, 2012

(51) Int. Cl.
*E02D 27/42* (2006.01)

(52) U.S. Cl.
USPC ..... 52/170; 52/296

(58) Field of Classification Search
USPC ..... 52/295, 296, 297, 293.3, 169.13, 52/170; 416/DIG. 6
See application file for complete search history.

(56) References Cited

U.S. PATENT DOCUMENTS

| | | | | |
|---|---|---|---|---|
| 3,791,087 | A * | 2/1974 | Sigal | 52/293.3 |
| 8,037,646 | B2 * | 10/2011 | Wobben | 52/126.3 |
| 2007/0251187 | A1 * | 11/2007 | Schiffer et al. | 52/741.14 |
| 2011/0138706 | A1 | 6/2011 | Voss et al. | |
| 2011/0138707 | A1 * | 6/2011 | Bagepalli | 52/173.1 |

OTHER PUBLICATIONS

Search Report issued in connection with EP Application No. 12183568.0, Jan. 31, 2013.

* cited by examiner

*Primary Examiner* — Christine T Cajilig
(74) *Attorney, Agent, or Firm* — Global Patent Operation; Douglas D. Zhang

(57) ABSTRACT

A tower base section, a tower adapter and a wind turbine having the tower base section and the tower adapter are provided. The tower base section includes a tubular side wall and a flange portion. The flange portion has an inner radius and an outer radius and is configured as a T-flange. The tubular side wall is located closer to the outer radius than to the inner radius. The adapter is arranged outside the tubular side wall and includes a bottom surface pressing from above on the flange portion.

17 Claims, 10 Drawing Sheets

TOWER BASE SECTION OF A WIND TURBINE, A WIND TURBINE AND A SYSTEM FOR MOUNTING A TOWER

BACKGROUND OF THE INVENTION

The subject matter described herein relates generally to a tower base section and a wind turbine and more particularly, to a tower base section of a wind turbine and a system for mounting a tower to a foundation.

Several technical installations require a tower or a mast to transfer reactions from lateral and gravity loads to the supporting foundation. Non-limiting examples of such installations are wind turbines, antenna towers used in broadcasting or mobile telecommunication, pylons used in bridge work, and power poles. Typically, the tower is made of steel and has to be connected to a foundation made of reinforced concrete. The common technical solution is to provide a so-called T-flange with through-holes at the bottom of the tower base section. Anchor bolts are inserted into the through-holes and are fastened in order to connect the base tower section to the foundation.

At least some known wind turbines include a tower and a nacelle mounted on the tower. A rotor is rotatably mounted to the nacelle and is coupled to a generator by a shaft. A plurality of blades extends from the rotor. The blades are oriented such that wind passing over the blades turns the rotor and rotates the shaft, thereby driving the generator to generate electricity.

The lowermost tower section, in the following also referred to as tower base section, of the wind turbine tower is secured to the foundation (e.g., a concrete slab or other suitable foundation). The tower base section may be formed at the lower end as a reverse T-flange with inner and outer through holes for anchor bolts connected to an anchor ring embedded in the foundation. The cross-sectional dimensions of each tower section, and in particular the base section must be sized to withstand all design operational and environmental loads (wind, seismic, ice, snow, etc.) and transfer them to the supporting foundation structure. The magnitudes of the design forces could exceed 2000 kN acting downward and 500 kN/150 kN on the lateral plane at the base of the tower in two orthogonal directions simultaneously. As wind turbine towers have become taller, the cross-sectional dimensions of the tower base section, including the T-flange, have become increasingly larger presenting difficulties in the ground transportation, for example by truck or rail, due to size limitations or roadways, bridges and tunnels through which these sections must pass in route to their assembly destination.

Alternatively, a continuous tower base ring may be used between a tubular lowermost tower section and the foundation. Two rows of anchor bolts, which are circumferentially distributed at a reverse T-flange of the tower base ring, are connected to the anchor ring embedded in the foundation. Higher forces may be transferred safely between the tower and the foundation by increasing the diameter of the tower base ring which leads to the same transportation challenges. The maximum transportable diameter in horizontal position is limited in many countries, for example to 4.3 m in Europe and 4.556 m in the US, due to transportation and logistic restrictions. Accordingly, a vertical transportation of the tower base ring with typical heights of about 1 m is often required. This increases transportation costs.

In view of the above, there is a desire for tower base sections and tower adapters that allow for cost efficient ground transportation and mount of tower base sections with large transverse cross-sectional dimensions.

BRIEF DESCRIPTION OF THE INVENTION

In one aspect, a tower base section of a wind turbine device is provided. The tower base section includes a tubular side wall and a flange portion which is configured as a T-flange. The flange portion includes an inner portion and an outer portion. The inner portion extends radially inward from the tubular sidewall up to a first length. The outer portion extends radially outward from the tubular sidewall up to a second length. The first length is larger than the second length.

In another aspect, a wind turbine is provided. The wind turbine includes a tower base section and an adapter. The tower base section includes a tubular side wall and a flange portion. The flange portion has an inner radius and an outer radius and is configured as a T-flange. The tubular side wall is located closer to the outer radius than to the inner radius. The adapter is arranged outside the tubular side wall and includes a shoulder pressing from above on the flange portion.

In yet another aspect, a system for mounting a tower to a foundation is provided. The system includes a tower base section having at a lower end a T-flange with an outer portion. The system further includes at least one adapter having a body with a through hole for an anchor bolt, a first bottom surface and a second bottom surface. The first bottom surface is configured to be arranged on the outer portion of the T-flange. The second bottom surface is, in direction of the through hole arranged below the first bottom surface and configured to be arranged on the foundation.

Further aspects, advantages and features of the present invention are apparent from the dependent claims, the description and the accompanying drawings.

BRIEF DESCRIPTION OF THE DRAWINGS

A full and enabling disclosure including the best mode thereof, to one of ordinary skill in the art, is set forth more particularly in the remainder of the specification, including reference to the accompanying figures wherein.

DETAILED DESCRIPTION OF THE INVENTION

Reference will now be made in detail to the various embodiments, one or more examples of which are illustrated in each figure. Each example is provided by way of explanation and is not meant as a limitation. For example, features illustrated or described as part of one embodiment can be used on or in conjunction with other embodiments to yield yet further embodiments. It is intended that the present disclosure includes such modifications and variations.

The embodiments described herein include a tower base section of a wind turbine, in particular with a large cross-sectional dimension, an adapter for fastening the tower base section to a foundation, and a respective wind turbine. The adapter allows for replacing a large tower base ring and thus more cost efficient ground transportation of the components to the erection site of the wind turbine. Furthermore, the outer diameter of the mounted adapter may be increased compared to the outer diameter of the tower base ring. In doing so, grout stress and concrete stress of the foundation may be reduced.

However, it should be understood that the present invention is not limited or restricted to wind turbines but can also be applied to tower structures used in other technical fields. In particular, the various embodiments of the present invention may also be applied to antenna towers used in broadcasting or mobile telecommunication or to pylons used in bridge work. Therefore, although the aspects of the invention will be exemplified with reference to a wind turbine, the scope of the present invention shall not be limited thereto.

As used herein, the term "blade" is intended to be representative of any device that provides a reactive force when in motion relative to a surrounding fluid. As used herein, the term "wind turbine" is intended to be representative of any device that converts rotational energy from wind energy, and more specifically, converts kinetic energy of wind into mechanical energy. As used herein, the term "wind generator" is intended to be representative of any wind turbine that generates electrical power from rotational energy generated from wind energy, and more specifically, converts mechanical energy converted from kinetic energy of wind to electrical power.

Figure 1:
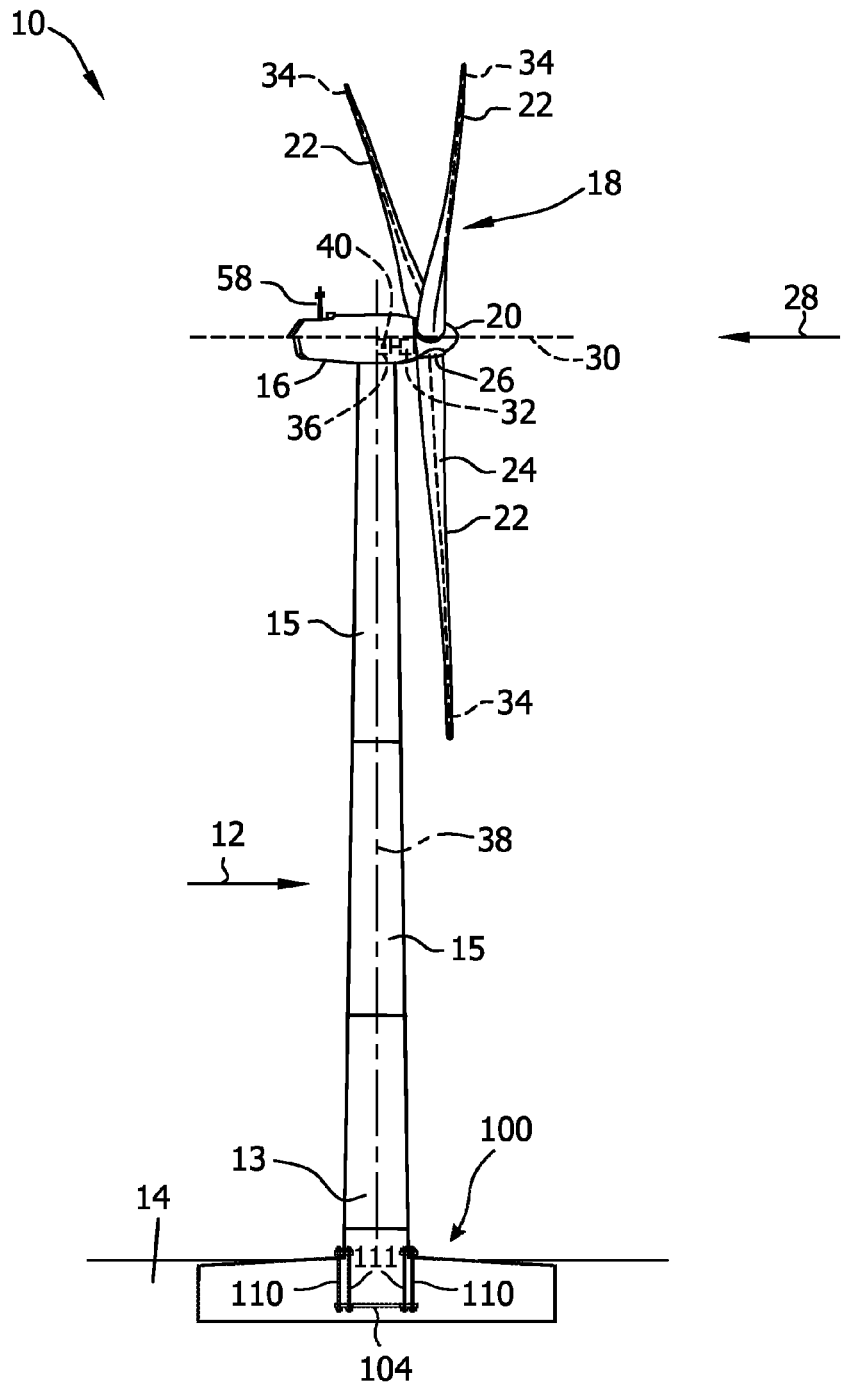
FIG. 1 is a perspective view of an exemplary wind turbine 10.

FIG. 1 is a perspective view of an exemplary wind turbine 10. In the exemplary embodiment, wind turbine 10 is a horizontal-axis wind turbine. Alternatively, wind turbine 10 may be a vertical-axis wind turbine. In the exemplary embodiment, wind turbine 10 includes a tower 12 that extends from a foundation 100, a nacelle 16 mounted on tower 12, and a rotor 18 that is coupled to nacelle 16. Typically, wind turbine 10 is an on-shore wind turbine. A major portion of foundation 100 is typically arranged in a soil 14. The tower 12 is fixed by anchor bolts 110, 111 extending to an anchor plate 104 which embedded in foundation 100. Typically, anchor bolts 110 and anchor bolts 111 are arranged on an outer ring and inner ring, respectively. The foundation 100 has to be large enough to resist the forces acting on wind turbine 10 during operation and/or high load wind conditions when turbine 10 is switched off.

Nacelle 16 also includes at least one meteorological mast 58 that includes a wind vane and an anemometer (neither shown in FIG. 1). Rotor 18 includes a rotatable hub 20 and at least one rotor blade 22 coupled to and extending outward from hub 20. In the exemplary embodiment, rotor 18 has three rotor blades 22. In an alternative embodiment, rotor 18 includes more or less than three rotor blades 22. In the exemplary embodiment, tower 12 is fabricated from tubular steel to define a cavity (not shown in FIG. 1) between foundation 100 and nacelle 16. In an alternative embodiment, tower 12 is any suitable type of tower having any suitable height.

Rotor blades 22 are spaced about hub 20 to facilitate rotating rotor 18 to enable kinetic energy to be transferred from the wind into usable mechanical energy, and subsequently, electrical energy. Rotor blades 22 are mated to hub 20 by coupling a blade root portion 24 to hub 20 at a plurality of load transfer regions 26. Load transfer regions 26 have a hub load transfer region and a blade load transfer region (both not shown in FIG. 1). Loads induced to rotor blades 22 are transferred to hub 20 via load transfer regions 26.

In one embodiment, rotor blades 22 have a length ranging from about 15 meters (m) to about 90 m. Alternatively, rotor blades 22 may have any suitable length that enables wind turbine 10 to function as described herein. For example, other non-limiting examples of blade lengths include 10 m or less, 20 m, 37 m, or a length that is greater than 90 m. As wind strikes rotor blades 22 from a direction 28, rotor 18 is rotated about an axis of rotation 30. As rotor blades 22 are rotated and subjected to centrifugal forces, rotor blades 22 are also subjected to various forces and moments. As such, rotor blades 22 may deflect and/or rotate from a neutral, or non-deflected, position to a deflected position.

Moreover, a pitch angle or blade pitch of rotor blades 22, i.e., an angle that determines a perspective of rotor blades 22 with respect to direction 28 of the wind, may be changed by a pitch adjustment system 32 to control the load and power generated by wind turbine 10 by adjusting an angular position of at least one rotor blade 22 relative to wind vectors. Pitch axes 34 for rotor blades 22 are shown. During operation of wind turbine 10, pitch adjustment system 32 may change a blade pitch of rotor blades 22 such that rotor blades 22 are moved to a feathered position, such that the perspective of at least one rotor blade 22 relative to wind vectors provides a minimal surface area of rotor blade 22 to be oriented towards the wind vectors, which facilitates reducing a rotational speed of rotor 18 and/or facilitates a stall of rotor 18.

In the exemplary embodiment, a blade pitch of each rotor blade 22 is controlled individually by a control system 36. Alternatively, the blade pitch for all rotor blades 22 may be controlled simultaneously by control system 36. Further, in the exemplary embodiment, as direction 28 changes, a yaw direction of nacelle 16 may be controlled about a yaw axis 38 to position rotor blades 22 with respect to direction 28.

In the exemplary embodiment, control system 36 is shown as being centralized within nacelle 16, however, control system 36 may be a distributed system throughout wind turbine 10, on support system 14, within a wind farm, and/or at a remote control center. Control system 36 includes a processor 40 configured to perform the methods and/or steps described herein. Further, many of the other components described herein include a processor. As used herein, the term "processor" is not limited to integrated circuits referred to in the art as a computer, but broadly refers to a controller, a microcontroller, a microcomputer, a programmable logic controller (PLC), an application specific integrated circuit, and other programmable circuits, and these terms are used interchangeably herein. It should be understood that a processor and/or a control system can also include memory, input channels, and/or output channels.

Figure 2:
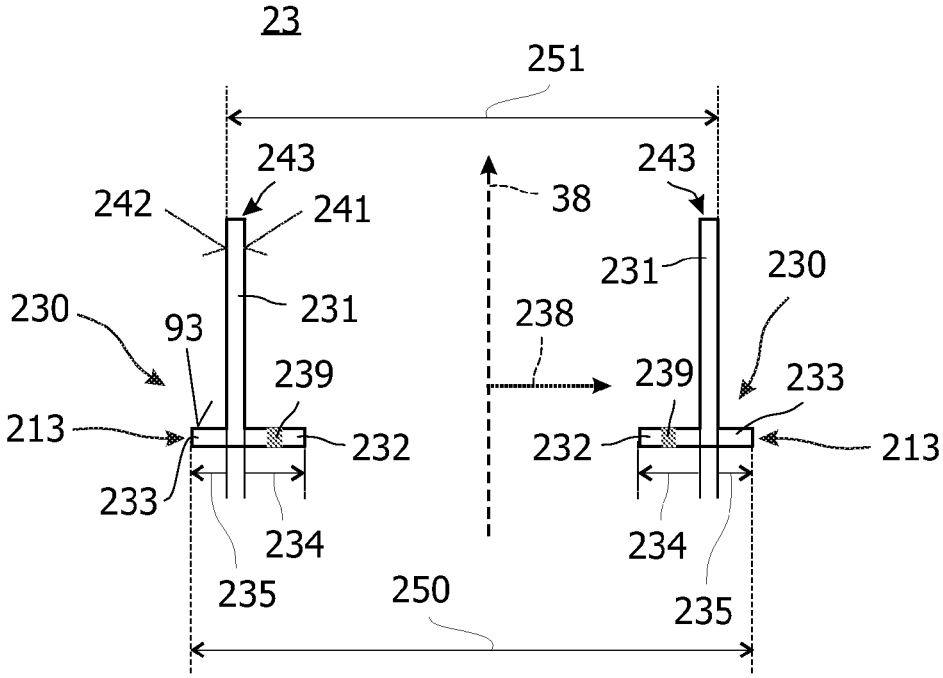
FIG. 2 illustrates in a vertical cross-section a tower base section according to an embodiment.

FIG. 2 illustrates a vertical cross-section of a tower base section 23 according to an embodiment. Tower base section 23 has a tubular side wall 231 extending to an upper end 243. In the exemplary embodiment, tubular side wall 231 is formed as a hollow cylinder having an inner surface 241 and an outer surface 242 and a central axis 38. Central axis 38 defines an axial direction 38 and a radial direction 238 which is orthogonal to the axial direction 38. An axial extension of tower base section 23 may be relatively large, typically ranging from about 10 m to about 20 m. Accordingly, tower base section 23 is typically transported in a horizontal position to comply with the maximum headroom of bridges and other ground transportation constrains.

As part of a wind turbine, tower base section 23 forms a lowermost or bottom section of a wind turbine tower supporting a nacelle. In this embodiment, the central axis 38 typically forms a yaw axis of the wind turbine. Tower base section 23 may include a door (not illustrated in FIG. 2) for accessing the wind turbine and may, therefore also referred to as door section. Upper end 243 is typically formed as a radially inward directed L-flange (not illustrated in FIG. 2) to which a further tower section may be mounted.

According to an embodiment, tower base section 23 is formed as a T-flange 230 at a lower end which is opposite to the upper end 243. T-flange 230 is formed by a lowermost portion of the tubular side wall 231 and a typically ring-shaped flange portion 213. Flange portion 213 includes an inner portion 232 and an outer portion 233. The inner portion 232 extends radially inward from the tubular sidewall 231 and the inner surface 241, respectively, up to a first length 234. The outer portion 233 extends radially outward from the tubular sidewall 231 and the outer surface 242, respectively, up to a second length 235. The first length 234 is larger than the second length 235. Typically, the first length 234 is at least about 1.5 times larger, more typically at least about 2.5 times larger, than the second length 235. In doing so, an outer diameter 250 of tower base section 23 is only slightly larger than an outer diameter 251 of the tubular side wall 231, for example by about up to 0.1 m or up to 0.2 m. This corresponds to a size range of the second length 235 from about 5 cm to about 10 cm. Accordingly, horizontal transport of tower base section 23 is facilitated.

Given that the outer diameter 250 of flange portion 213 for horizontal transport is limited to 4.556 m and 4.3 m in the US and Europe, respectively, this is particularly important for embodiments in which the tower base section 23 is configured to carry loads of more than about 2000 kN. Typically, reducing the size of flange outer portion 233 is compensated by increasing the flange inner portion 232.

For stability reasons, tower base section 23 is typically made of steel for the wind turbine application.

According to an embodiment, only inner portion 232 of flange portion 213 includes through holes 239 for anchor bolts. Through holes 239 extend substantially parallel to the tubular side wall 231 and the axial direction 38, respectively. Typically, an inner ring of through holes 239 is formed through inner portion 232 for fastening tower base section 23 to a foundation (not illustrated in FIG. 2) via anchor bolts. More inner rings of through holes 239 may be formed through inner portion 232 if needed.

Different thereto, outer portion 233 is typically monolithic without any through holes. Accordingly, a high mechanical strength of outer portion 233 and a connection between outer portion 233 and tubular side wall 231 is ensured. This enables applying large forces onto an upper surface 93 of outer portion 233. Accordingly, tower base section 23 may additionally or even only be fastened to the foundation by exerting a large enough clamping force onto upper surface 93. For example, a lower surface of an adapter may circumferentially be pressed on upper surface 93. As will be explained in more detailed below, this may be achieved by fixing the adapter by nuts to an outer ring of anchor bolts fastened to the foundation.

Figure 3:
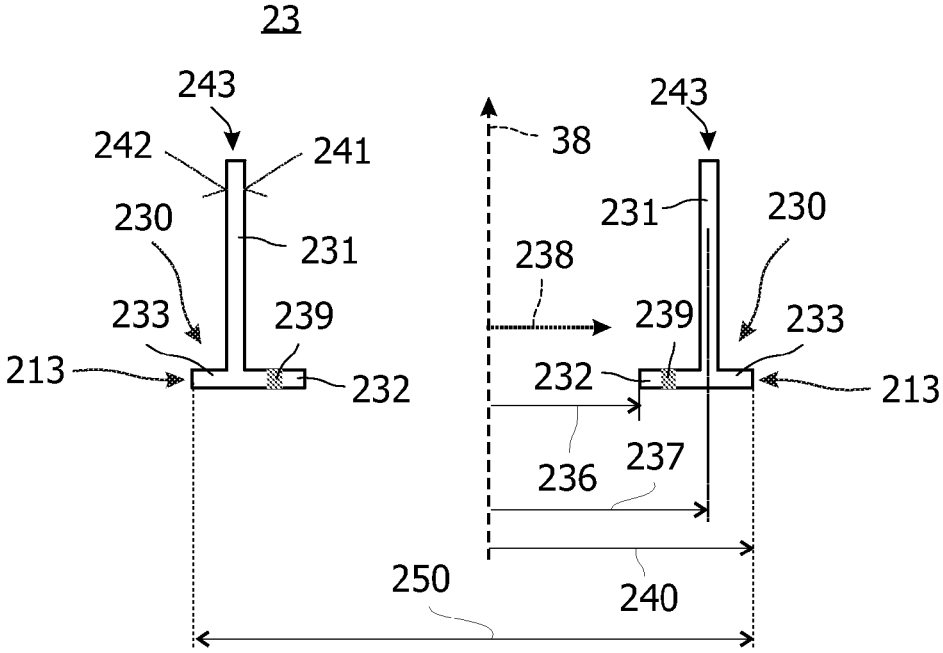
FIG. 3 illustrates in a vertical cross-section a tower base section according to another embodiment.

FIG. 3 illustrates a further embodiment of tower base section 23 in a cross-sectional view. The typically ring-shaped flange portion 213 of T-flange 230 extends from an inner radius 236 up to an outer radius 240 so that the tubular side wall 231 is located closer to the outer radius 240 than to the inner radius 236. For example, a mean radius 237 of a typically radially symmetric tubular side wall 231 may be larger, for example by about 10 cm to about 20 cm, than a half of the sum of outer radius 240 and inner radius 236. In doing so, the outer diameter 250 of tower base section 23 is only slightly larger than an outer diameter of the tubular side wall 231 which facilitates horizontal transport of tower base section 23.

Figure 4:
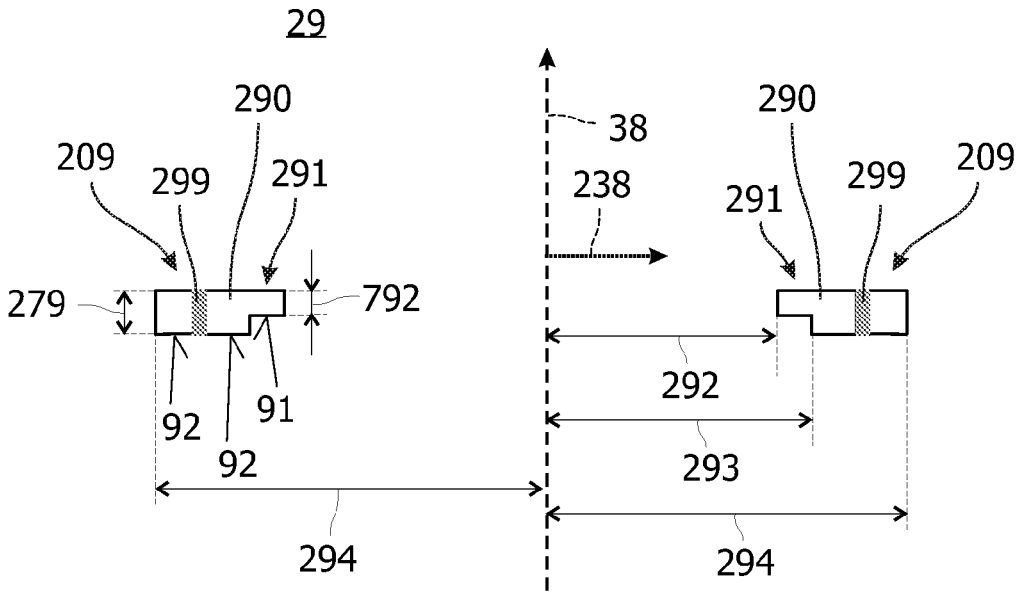
FIG. 4 illustrates in a vertical cross-section a tower adapter according to an embodiment.

FIG. 4 illustrates a vertical cross-section of an adapter 29 for fastening a tower base section, as explained with reference to FIGS. 2 and 3, to a foundation (not illustrated in FIG. 4) according to an embodiment. Adapter 29, in the following also referred to as tower adapter, has a body 290 with a fastening portion 209 and a retaining portion 291.

According to an embodiment, retaining portion 291 is formed as a shoulder which is formed such that the shoulder may be arranged on an outer portion of a T-flange forming a lower end of the tower base section as explained with reference to FIGS. 2 and 3. At least one through hole 299 for an anchor bolt extends through fastening portion 209. Accordingly, tower adapter 29 may be used to fasten the tower base section to the foundation. In doing so, no tower base ring is needed for erecting a wind turbine tower. Thus, production and transportation costs may be saved. Furthermore, erection time may be decreased as the number of flange pairs to be screwed together is typically reduced.

Typically, shoulder 291 has a first bottom surface 91, for example a flat surface that may be arranged on a respective upper surface of the outer portion of the T-flange. A second bottom surface 92 is, in direction of through hole 299, arranged below the first bottom surface 91 and configured to be arranged on the foundation. During and/or after fastening portion 209 by nuts to anchor bolts, first bottom surface 91 typically presses on the lower surface of the outer portion. Accordingly, the T-flange and thus the tower base section are clamped to the foundation. Therefore, retaining portion 291 is in the following also referred to as clamping portion.

According to an embodiment, tower adapter 29 is ring shaped or shaped as a ring-segment. Typically, both the fastening portion 209 and clamping portion 291 are ring shaped or ring-segment shaped, for example shaped as a circular ring or a circular ring-segment. Accordingly, a monolithic ring-shaped tower adapter or a segmented adapter of two or more ring-segment shaped tower adapters may circumferentially be arranged around and pressed on a ring-shaped outer portion of the T-flange. In doing so, a uniform clamping of the tower base section may be provided.

For example, tower adapter 29 may have a first radius 292, a second radius 293, which is larger than the first radius 292, and an outer radius 294 which is larger than the second radius 293. When the tower adapter 29 is shaped as a ring-segment, the first radius 292, the second radius 293 and the outer radius 294 typically only form radii of curvature. The difference between the second radius 293 and the first radius 292 determines the extension of lower surface 92 in radial direction 238 and of a radially inward protruding portion of the clamping portion 291, respectively. Typically, the difference between the second radius 293 and the first radius 292 ranges from about 5 cm to about 25 cm, more typically from about 10 cm to about 20 cm. The difference between the outer radius 294 and the second radius 293 typically ranges from about 20 cm to about 40 cm, more typically from about 25 cm to about 35 cm.

The outer radius 294 may be larger than about 2.15 m and 2.27 m for Europe and US, respectively. With these dimensions a monolithic tower adapter 29 typically allows for a non-horizontal transportation on the road in many countries. However, since the dimension 279 of tower adapter 29 in axial direction 38 and length of through holes 299, respectively, is below the ground transportation vertical limits, typically below 0.5 m, more typically below 0.25 m, or even below 0.15 m, transportation costs are reduced compared to radially equally sized tower base rings.

Furthermore, using two or more ring-segment-shaped tower adapters segments enables horizontal transportation even for substantially larger outer curvature radii 294. In doing so, the diameter of an outer ring of anchor bolts and the contact surface between fastening portion 209 of mounted tower adapter and the foundation may be increased. This facilitates reducing mechanical stress.

It is understood, though, that the shape of tower adapter 29 may also be adapted to other than circular, for example hexagonal, cross-sections of the tower base section and the T-flange, respectively.

For reasons of stability, tower adapter 29 typically is formed of steel. Other suitable materials may also be used to make tower adapter 29. It is understood, though, that other suitable fabrication techniques and methods may be used to make tower adapter 29.

To ensure sufficiently high mechanical stability at reasonable weight, the minimum height 792 for the retaining portion 291 has, in direction 38, i.e. in a direction which is substantially parallel to the through hole 299, a minimum height 792 which is in a range from about 2 cm to about 25 cm, more typically in a range from about 5 cm to about 20 cm, even more typically in a range from about 7 cm to about 10 cm.

Figure 5:
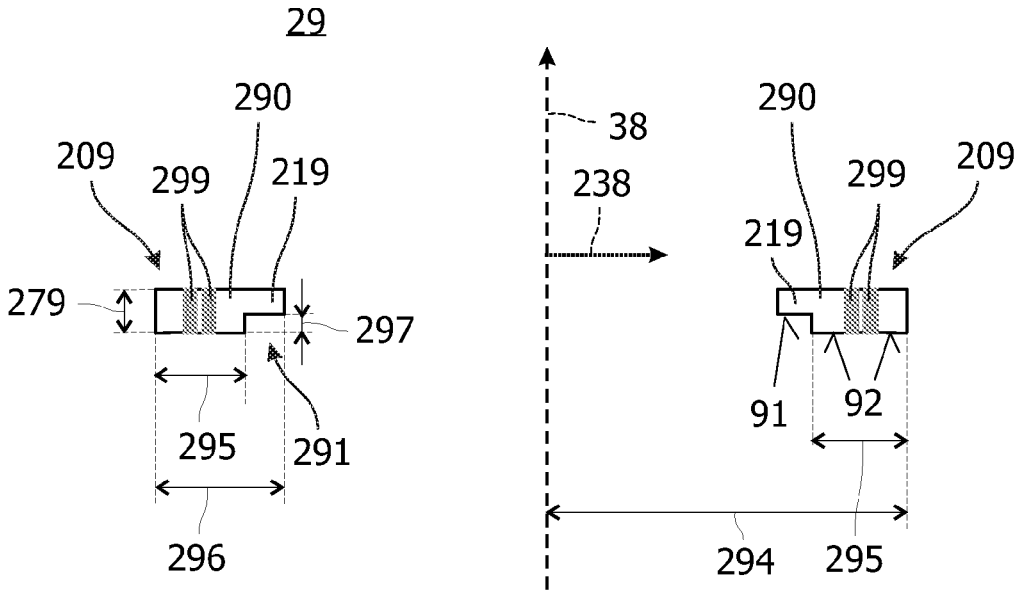
FIG. 5 illustrates in a vertical cross-section a tower adapter according to another embodiment.

FIG. 5 illustrates another embodiment of a tower adapter 29 in a cross-sectional view. In the exemplary embodiment, tower adapter 29 has a substantially ring-shaped or ring segment-shaped body 290 with an outer radius 294 which exceeds a maximum outer radius of a T-flange of a tower base section around which tower adapter 29 may be arranged. A protrusion 219 extends radially inward so that a shoulder 291 with a lower surface 92 is formed that may be applied to an upper surface of an outer portion of the T-flange for clamping the tower base section to a foundation.

Typically, the shoulder 291 has, in a direction 38 which is substantially parallel to a through hole 299 formed through a radially outward lying fastening portion 209 of the body 209, a step height 297 which is slightly smaller, for example by a few mm up to about 1 cm, than the outer portion of the T-flange in this direction. Accordingly, high clamping forces may be applied to the T-flange.

In the exemplary embodiment, two radially spaced apart through holes 299 extend through the second bottom surface 92 of each of the illustrated portions of tower adapter 29. Accordingly, higher clamping forces may be applied to the tower base section.

Figure 6:
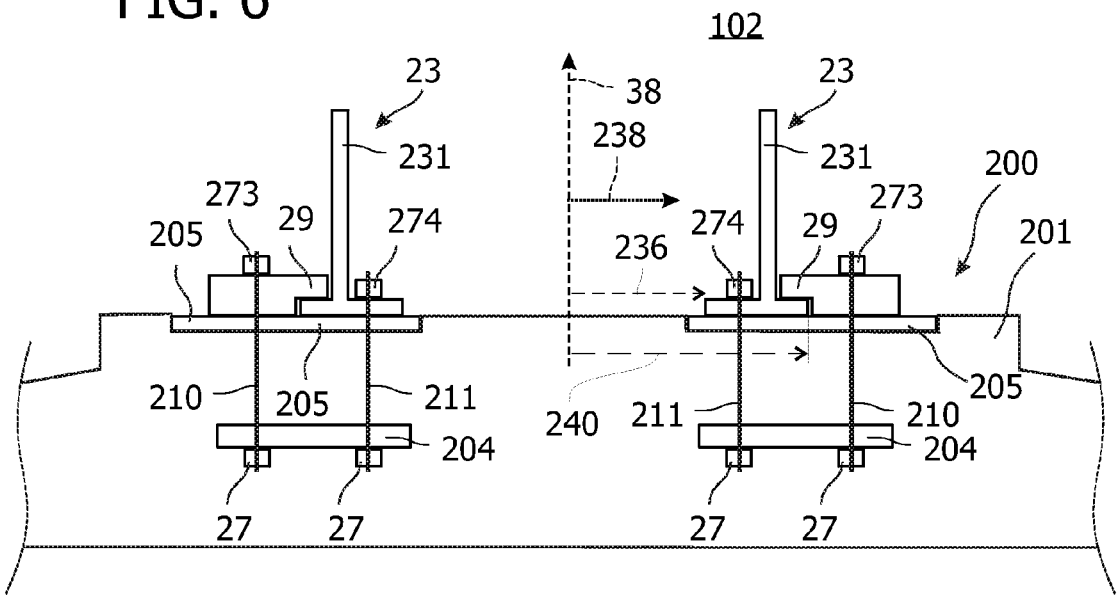
FIG. 6 illustrates in a vertical cross-section a tower base section including its foundation according to an embodiment.

FIG. 6 illustrates a vertical cross-section of a system for mounting a tower to a foundation according to an embodiment. Typically, the system corresponds to a lower portion of a wind turbine 102 including its foundation 200. A tower base section 23, typically a tower base section as explained with reference to FIGS. 2 and 3, is fastened using a tower adapter 29, typically a tower adapter as explained with reference to FIGS. 4 and 5, to foundation 200. Tower base section 23 includes a tubular side wall 231 which defines an axial direction 38. Further, tower base section 23 includes a flange portion to form a reversed T-flange in the lowermost part of tower base section 23. The flange portion extends radially between an inner radius 236 and an outer radius 240. The tubular side wall 231 is located closer to the outer radius 240 than to the inner radius 236. Tower adapter 29 is arranged outside tubular side wall 231 and presses with a clamping portion formed as a shoulder and a radially inward arranged protrusion, respectively, from above on an outer portion of the flange portion.

Typically, at least one vertical through hole 299 is formed through tower adapter 29 in a fastening portion. The at least one vertical through hole 299 is, in a radial direction 238, spaced apart from the shoulder and the radially inward arranged protrusion, respectively. Tower adapter 29 is fastened with anchor bolts 210 extending through respective through holes into a foundation body 201 arranged below the tower base section 23. Typically, nuts 273 are used to fix tower adapter 29 to anchor bolts 210. For given rated mechanical load of the tower and tower base section 23 respectively, outer radius 240 may be chosen larger than a maximum outer radius of a tower base ring without increasing transportation costs. Accordingly, the diameter of an outer ring of anchor bolts 210 and the contact surface between tower adapter 29 and foundation 200 may be increased. This typically reduces mechanical stress in the foundation 200 and also increases stability of the tower-foundation assembly. For example, a diameter of the outer ring of anchor bolts is larger than about 4.25 m or even larger than about 4.5 m.

In addition, tower base section 23 is typically fixed by nuts 274 to anchor bolts 211. Accordingly, fastening of tower base section 23 to foundation 200 is typically further improved.

Foundation body 201 is typically made of reinforced concrete. Since the surface of concrete may be fairly rough, tower adapter 29 and base tower segment 23 are typically arranged on a grout joint 205 formed on foundation body 201 and a recess of foundation body 201, respectively. In these embodiments, tower adapter 29 presses tower base section 23 onto grout joint 205.

According to an embodiment, a step height of the shoulder is in an axial direction 38 slightly smaller, for example by a few mm up to about 1 cm or even to about 2 cm, than a height of an adjoining underlying portion of the flange portion. Accordingly, tower base section 23 may be strongly clamped by screwing nuts 273 to anchor bolts 210 for fixing tower adapter 29.

Typically, an anchor plate, for example the illustrated anchor ring 204 is embedded in foundation body 201 for strongly anchoring anchor bolts 210 and/or anchor bolts 211 in foundation body 201. Anchor bolts 210 and/or anchor bolts 211 may be fixed by nuts 27 to anchor ring 204.

According to typical embodiments described herein, anchor bolts 210, 211 can range in from about 1 m to about 3 m, for example of about 2 m. The anchor bolts 210, 211 can also be referred to as tensioning bolts or reinforcing bolts.

Figure 7:
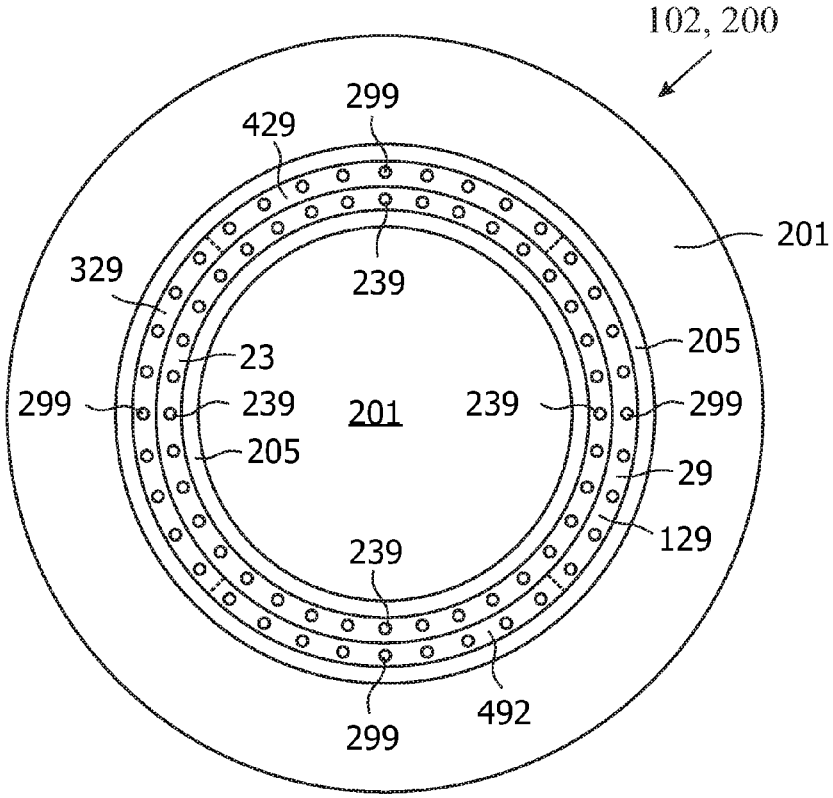
FIG. 7 illustrates in a plane view a tower base section and a foundation according to an embodiment.

FIG. 7 illustrates system and the wind turbine 102 including its foundation 200, respectively, in a schematic plane view on tower base section 23 according to an embodiment. For sake of clarity, anchor bolts and nuts are not shown in FIG. 7. Instead, inner through holes 239 of the T-flange of tower base section 23 and through holes 299 of tower adapter 29 are shown. Tower adapter 29 circumferentially surrounds tower base section 23. Accordingly, high clamping forces may be uniformly applied to the outermost portion of the reversed T-flange of tower base section 23. Typically, a plurality of through holes 239, 299 is provided to ensure high enough clamping forces.

Tower adapter 29 may be monolithic or may include several tower adapter segments 129, 239, 429, 492 as indicated by the dashed lines. Instead of the illustrated four tower adapter segments 129, 239, 429, 492, two three or any other number of tower adapter segments may be used. In the exemplary embodiment illustrated in FIG. 7, 36 through holes 299 are provided. The number of segments with one, two or more through-holes per segment should be determined based on the specific application. Typically, the tower adapter segments 129, 239, 429, 492 are substantially formed as ring segments. Accordingly, the tower adapter segments 129, 239, 429, 492 may adjoin each other. This increases stability. Further, assembly may be facilitated.

According to further embodiments, more than one circle of through holes 299 for anchor bolts can be formed through tower adapter 29. For example, a first ring of through holes 299 having a slightly smaller diameter than an outer ring of through holes 299 for anchor bolts. Accordingly, two rings of outer anchor bolts may be provided. Thus, the stability of the assembled wind turbine tower may be even further improved. For example, a total of 36 anchor bolts can be provided as two rings. According to other embodiments, more than 36 anchor bolts, e.g., a total of 72 or even 96 anchor bolts can be provided. According to yet different embodiments, the rings of bolts can have diameters which are spaced apart appropriately, for example by several centimeters.

Figure 8:
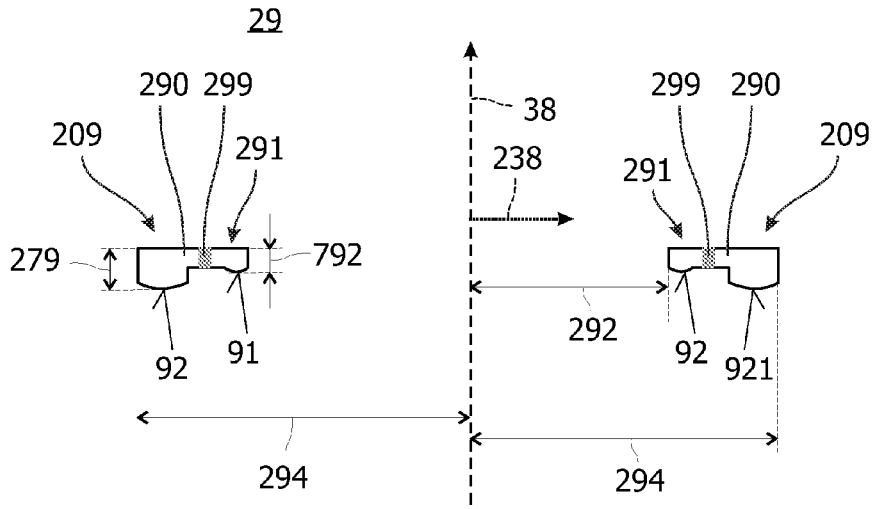
FIG. 8 illustrates in a vertical cross-section a tower adapter according to another embodiment.

FIG. 8 illustrates another embodiment of a tower adapter 29 in a cross-sectional view. In the exemplary embodiment, tower adapter 29 has a substantially ring-shaped or ring segment-shaped body 290 with an outer radius 294 which exceeds a maximum outer radius of a T-flange of a tower base section around which tower adapter 29 may be arranged. A through hole 299 for an anchor bolt is formed through a body 290 of tower adapter 29. Body 290 includes a first bottom surface 91 which is configured to be arranged on an outer portion of a T-flange. Body 290 includes a second bottom surface 92 which is, in direction of the through hole 299, arranged below the first bottom surface 92 and may be arranged on a foundation. Accordingly, a tower base section, for example a tower base section of a wind turbine, may be clamped to the foundation.

Whereas the through hole of adapters explained with reference to FIGS. 4, 5 extend through the second bottom surface, the through holes 299 of adapter 29 of FIG. 8 are arranged between the first bottom surface 91 and the second bottom surface 92.

In the exemplary embodiment, the first bottom surface 91 and the second bottom surface 92 are not flat but protrude downward. Typically, the first bottom surface 91 and the second bottom surface 92 are convex. Using downward protruding bottom surfaces 91, 92 and convex bottom surfaces 91, 92, respectively allows for strong contact with below arranged surfaces, even if the below arranged surfaces are not flat and/or if their elevations differ from the designed elevations. Typically, at least the second bottom surface 92 is convex.

Figure 9:
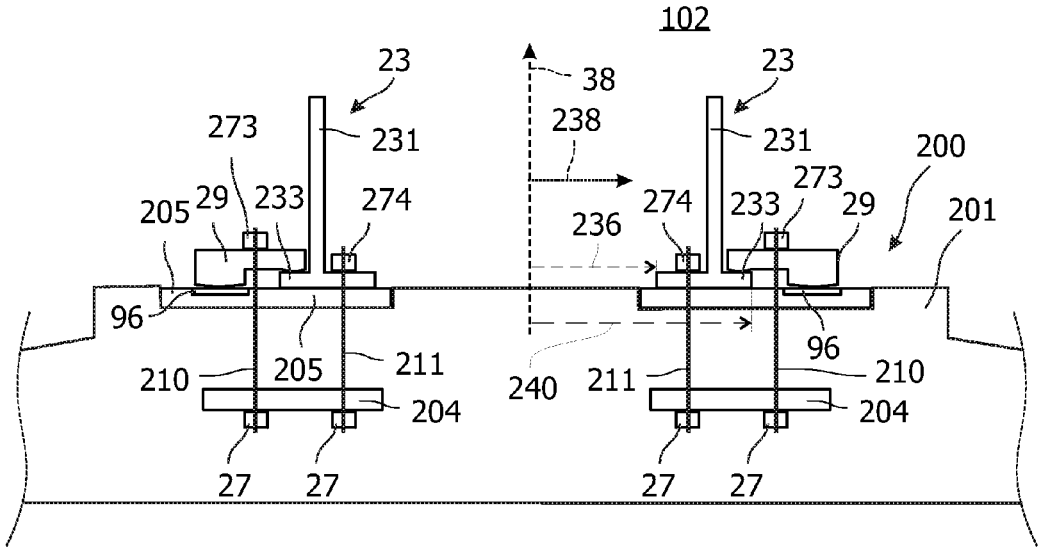
FIG. 9 illustrates in a vertical cross-section a tower base section and a foundation according to an embodiment.

FIG. 9 illustrates a vertical cross-section of a system for mounting a tower to a foundation 200 according to an embodiment. Typically, the system corresponds to a lower portion of a wind turbine 102 including its foundation 200. A tower base section 23, typically a tower base section 23 as explained with reference to FIGS. 2 and 3, is fastened using a tower adapter 29, typically a tower adapter 29 as explained with reference to FIGS. 4, 5 and 8, to foundation 200. Tower base section 23 is arranged on a grout joint 205 of foundation 200 and includes at a lower end a T-flange having an outer portion 233 and an inner portion. Only the inner portion includes through holes for fastening tower base section 23 to foundation 200 with inner anchor bolts 211. Adapter 29 is arranged with a first bottom surface 91 and a second bottom surface 92 on outer portion 23 and a circumferential steel plate 96 embedded in grout joint 201. At least one through hole, typically a plurality of through holes, is formed through a body of adapter 29 between the first bottom surface 91 and the second bottom surface 92. At least one outer anchor bolt 210, typically a plurality of outer anchor bolts 210, is used to fasten adapter 29 to foundation 200 by respective nuts 273. Accordingly, tower base section 23 is safely secured to foundation 200.

Typically, the first and second bottom surfaces of adapter 29 are convex, as explained with reference to FIG. 8. Accordingly, strong contact between the adapter 29 and the outer portion 23 and between the adapter 29 and an embedded steel ring 96, which is in the following also referred to as circumferential metal plate, may be formed. In the exemplary embodiment, steel ring 96 is embedded in grout joint 205 to allow for higher clamping forces without damaging grout joint 205. Assuring good contact between two flat surfaces typically requires a high precision. Using convex first and/or second bottom surfaces typically saves costs.

Figure 10:
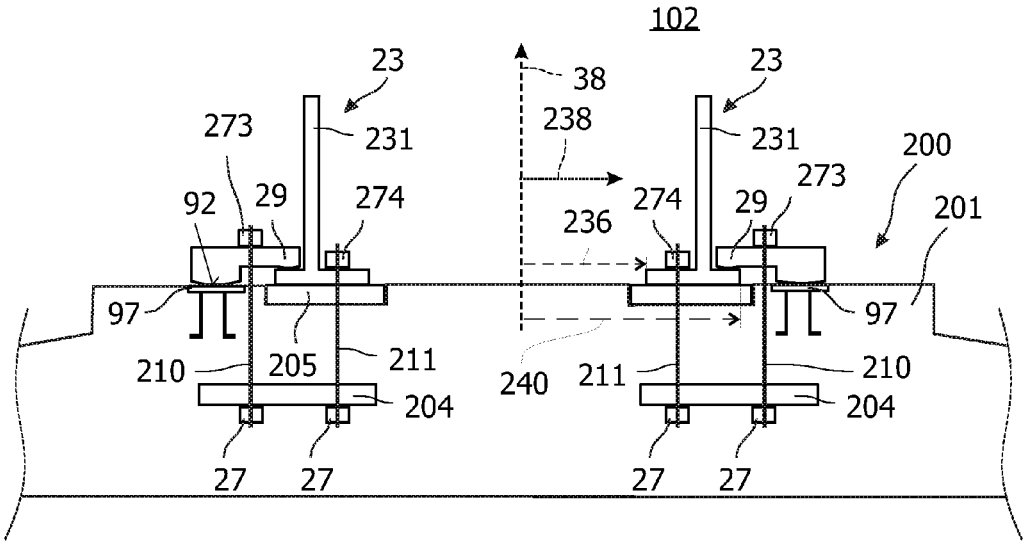
FIG. 10 illustrates in a vertical cross-section a tower base section and a foundation according to still an embodiment.

Next, an embodiment is described with reference to FIG. 10. The system for mounting a tower to a foundation 200 and the wind turbine, respectively, shown in FIG. 10 is very similar to the exemplary embodiment described above with regard to FIG. 9. However, steel ring 97 illustrated in FIG. 10 is directly embedded in foundation body 201. Accordingly, even higher clamping forces may be applied. Steel ring 97 may be in contact with a reinforcement of foundation body 20. This allows for very high clamping forces and may in addition facilitate forming foundation 200 and erection of wind turbine 102, respectively.

Figure 11:
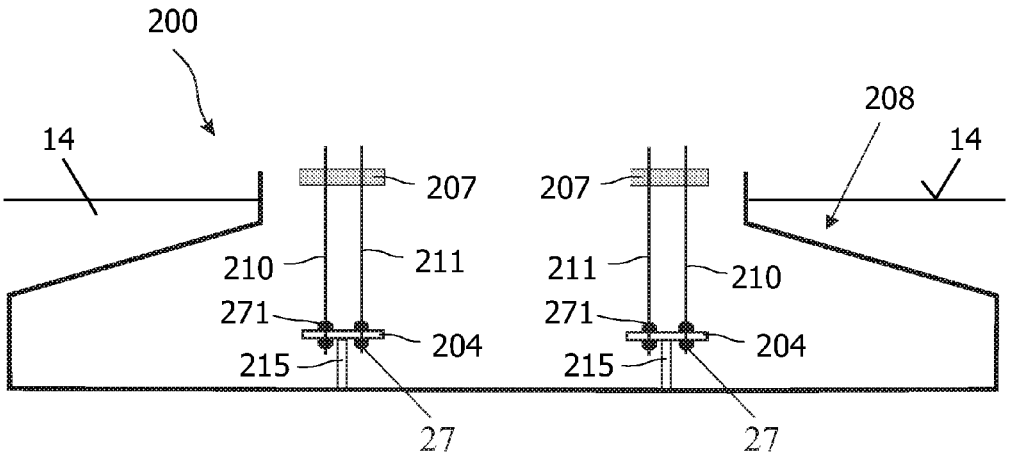
FIGS. 11 to 16 illustrate a method for forming a tower foundation, anchoring system, and tower base placement according to embodiments.

FIGS. 11 to 16 illustrate in cross-sectional views a method for forming a tower foundation 200 and a wind turbine according to embodiments. In a first process a frame work 208 including a base plate is formed. Typically, frame work 208 is at least partially arranged in a soil 14. Inner anchor bolts 211 and outer anchor bolts 210 are mounted to an anchor ring 204, typically by nuts 27, 271. A template 207 is mounted to the inner anchor bolts 211 and/or the outer anchor bolts 210. Anchor ring 204 including inner anchor bolts 211, outer anchor bolts 210 and template 207 are arranged within frame work 208, for example on a support 215, so that the inner anchor bolts 211 and outer anchor bolts 210 protrude out of frame work 208. The resulting tower foundation 200 is illustrated in FIG. 11.

Figure 12:
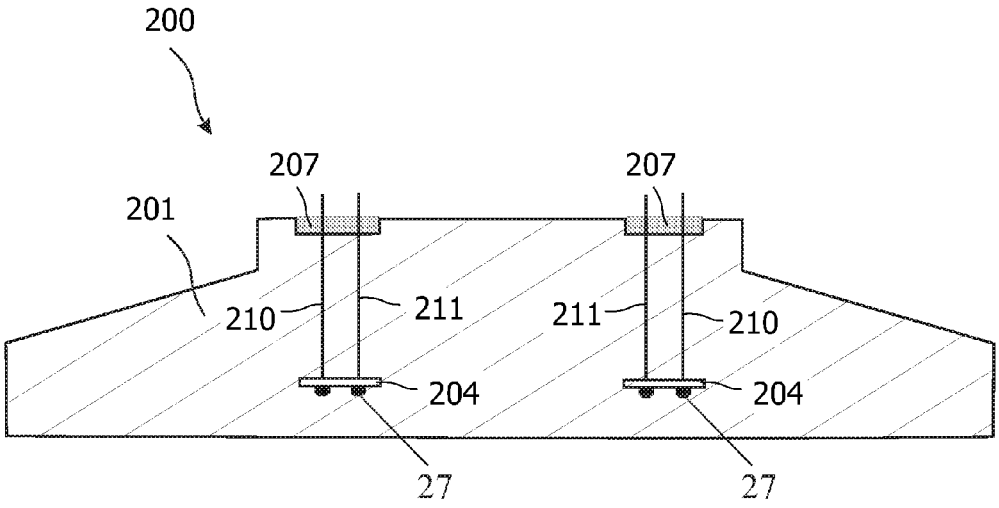

Thereafter, a reinforcement is typically installed in frame work 208. Furthermore, an optional circumferential steel plate (not illustrated in FIG. 12) as explained with regard to FIG. 10 may be arranged within frame work 208 and fastened to the reinforcement. This is typically followed by pouring concrete into frame work 208 and curing the concrete to form a foundation body 201. The resulting tower foundation 200 is illustrated in FIG. 12.

Figure 13:
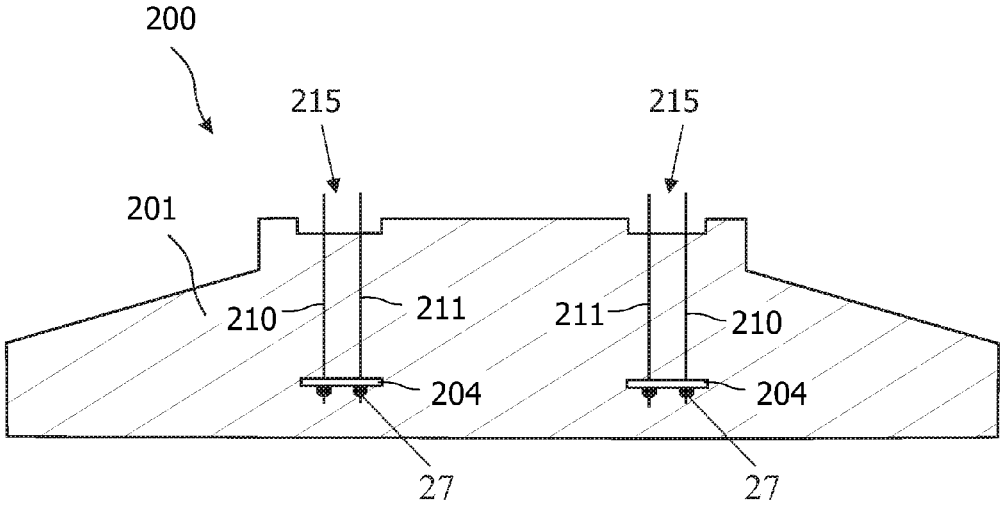

Thereafter, template 207 may be removed as illustrated in FIG. 13. Accordingly, a typically ring-shaped recess 215 of foundation body 201 becomes accessible. Particularly, recess 215 is formed such that the anchor bolts 210, 211 extend from a bottom surface of recess 215, i.e. recess 210 is located above and aligned with anchor ring 204.

Figure 14:
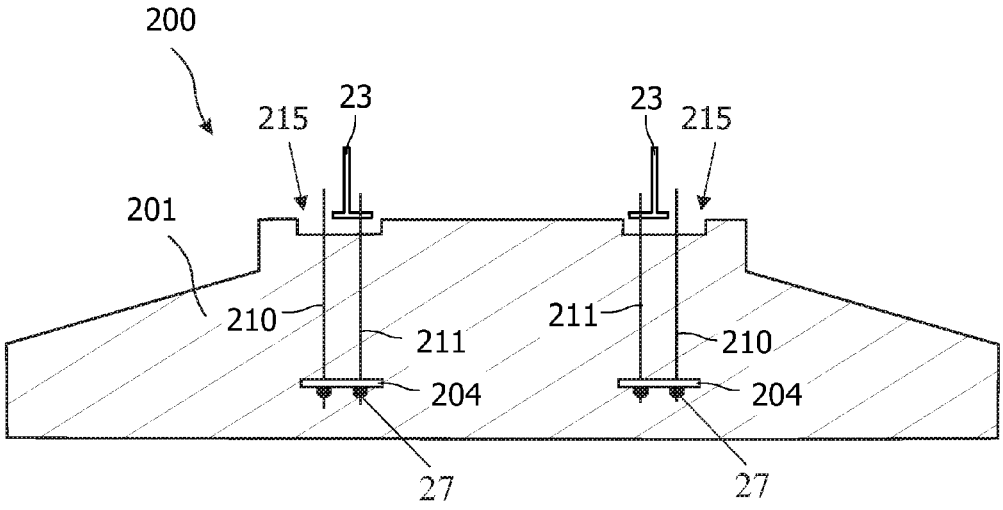

Thereafter, a tower base section 23 as explained with reference to FIGS. 2 and 3 is typically above recess 215 so that inner anchor bolts 211 protrude through holes in an inner portion of a reversed T-flange of tower base section 23. The resulting tower foundation 200 is illustrated in FIG. 14. Typically, tower base section 23 is placed on spacers (not illustrated in FIG. 14) to bridge recess 215. Furthermore, an optional circumferential steel plate (not illustrated in FIG. 14) as explained with regard to FIG. 9 may be arranged on spacers in recess 215.

Figure 15:
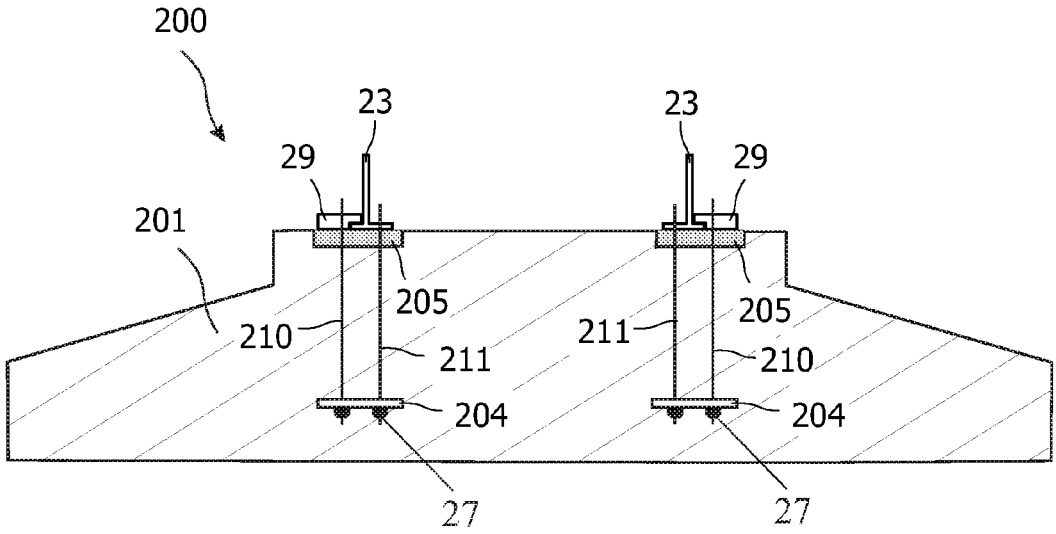

Normally, the concrete surface of the foundation is relatively rough. Therefore, grout is typically poured into recess 215 to form a grout joint 205. After curing, a tower adapter 29 as explained with reference to FIGS. 4, 5 and 8 may be placed on base tower segment 23 and grout joined 205 so that outer anchor bolts 210 protrude through holes in a clamping portion of tower adapter 29. Tower adapter 29 may, for example, be a monolithic ring-shaped tower adapter or a segmented adapter of ring-segment shaped tower adapters. Accordingly, tower adapter 29 may circumferentially surround tower base section 23. The resulting tower foundation 200 is illustrated in FIG. 15.

Figure 16:
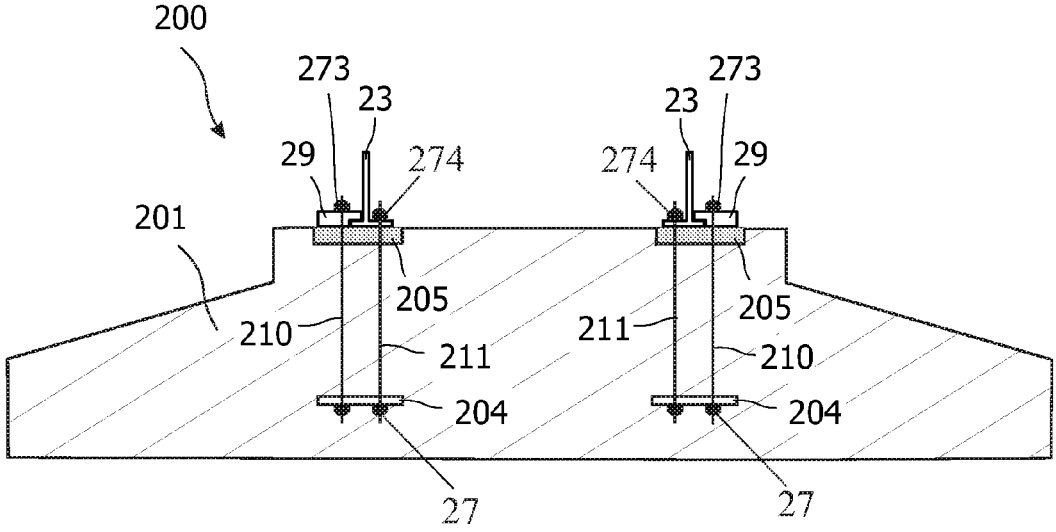

Thereafter, tower base section 23 is fastened with nuts 274 to inner anchor bolts 211 and tower adapter 23 is fastened with nuts 273 to outer anchor bolts 210. Typically, tower adapter 23 is pressed on tower base section 23 by screwing on nuts 273. Since a step height of tower adapter 23 is typically slightly lower than a height of the underlying portion of the T-flange of tower base section 23, large clamping forces may be applied by screwing nuts 273 to anchor bolts 210. The resulting tower foundation 200 is illustrated in FIG. 16.

Thereafter, further tower sections may be mounted to tower base section 23 and to one another, respectively, to form a wind turbine tower. This is typically followed by mounting a nacelle to the uppermost tower section, installing electric and mechanic components such as a gear box, a generator and an inverter in the nacelle and mounting a spinner to the nacelle and rotor blades to the spinner.

Figure 17:
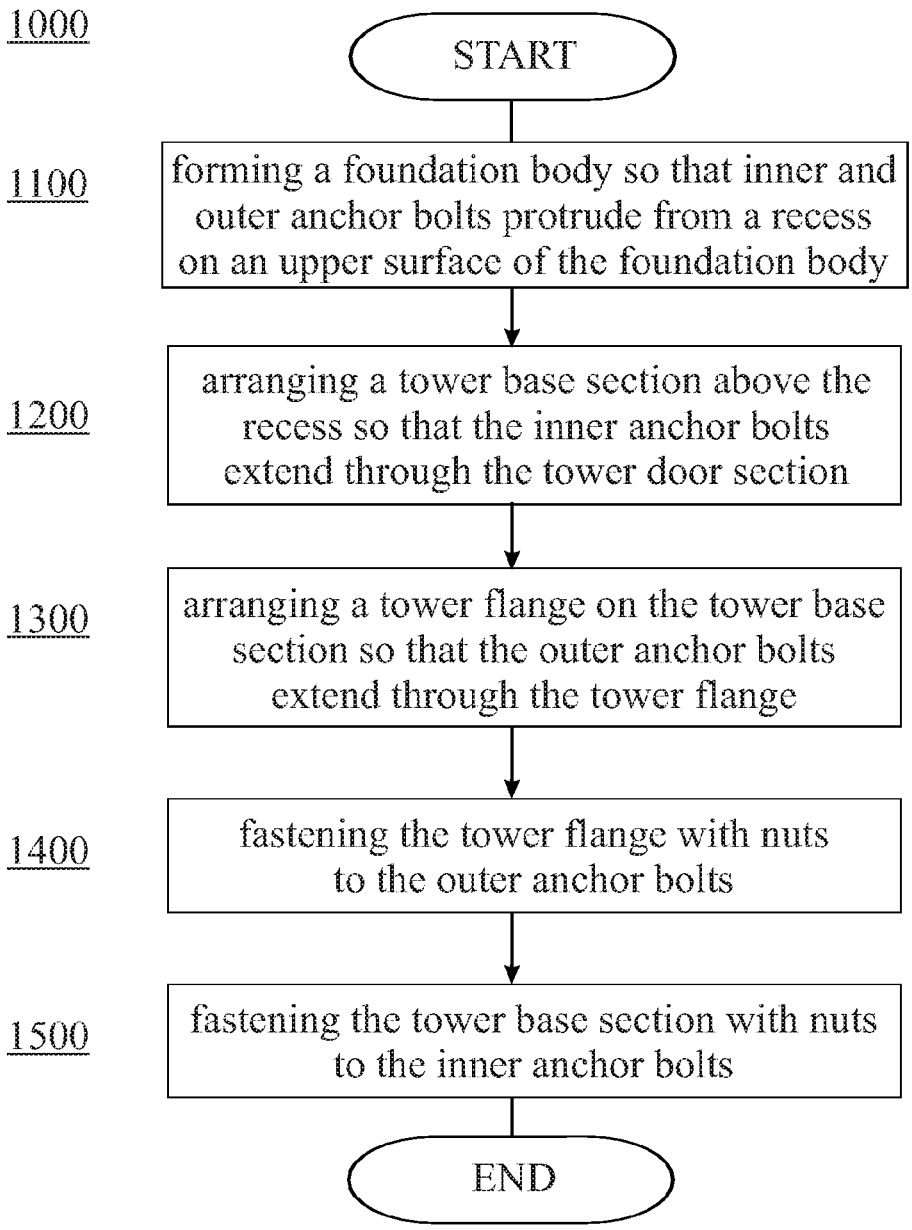
FIG. 17 illustrates a flow diagram for forming a tower foundation, anchoring system, and tower base placement according to embodiments.

FIG. 17 illustrates a flow diagram of a method 100 for forming a tower foundation and a wind turbine according to embodiments. Typically, method 1000 corresponds to processes as explained with reference to FIGS. 8 to 13.

In a first block 1100 a foundation body is formed so that inner anchor bolts and outer anchor bolts protrude from a recess on an upper surface of the foundation body. This is typically done as explained with reference to FIGS. 8 to 10.

In a subsequent block 1200, a tower base section formed as a reversed T-flange in a lowermost portion, is arranged above the recess so that the inner anchor bolts extend through holes of the T-flange. This is typically done as explained with reference to FIG. 11 and followed by forming a grout joint in the recess.

In a subsequent block 1300, a tower adapter is arranged outside and on the T-flange so that the outer anchor bolts extend through holes of the tower adapter. This is typically done as explained with reference to FIG. 11.

In subsequent blocks 1400 and 1500, the tower adapter is fastened to the outer anchor bolts by nuts, thereby exerting a clamping force on the T-flange, and the T-flange is fastened by nuts to the inner anchor bolts.

Exemplary embodiments of systems and methods for erecting a tower, in particular a wind turbine tower are described above in detail. The systems and methods may sloe be applied for other types of towers such as antenna towers used in broadcasting or mobile telecommunication, pylons used in bridge work, and power poles. Furthermore, the systems and methods are not limited to the specific embodiments described herein, but rather, components of the systems and/or steps of the methods may be utilized independently and separately from other components and/or steps described herein.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. While various specific embodiments have been disclosed in the foregoing, those skilled in the art will recognize that the spirit and scope of the claims allows for equally effective modifications. Especially, mutually non-exclusive features of the embodiments described above may be combined with each other. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A wind turbine comprising:

a tower base section comprising a tubular side wall and a flange portion, the flange portion comprising an inner radius and an outer radius and being configured as a T-flange, the tubular side wall being located closer to the outer radius than to the inner radius; and an adapter arranged outside the tubular side wall, the adapter comprising a retaining portion defining a first bottom surface pressing from above on the flange portion, and a fastening portion extending radially outward from the retaining portion, the fastening portion being configured to be arranged on a foundation body arranged below the tower base section, the retaining portion forming a shoulder configured to be arranged on the flange portion.

2. The wind turbine of claim 1, wherein the adapter is circumferentially arranged around the tower base section.

3. The wind turbine of claim 1, wherein at least two adapters are arranged around the tower base section.

4. The wind turbine of claim 3, wherein the at least two adapters are substantially formed as ring segments.

5. The wind turbine of claim 1, wherein the adapter further comprises at least one through hole which is arranged radially outward from the first bottom surface, and wherein the adapter is fastened to a bolt extending through the at least one through hole and into the foundation body arranged below the tower base section.

6. The wind turbine of claim 5, wherein the flange portion is arranged on a grout joint arranged on the foundation body.

7. The wind turbine of claim 1, wherein the fastening portion comprises a second bottom surface which is arranged below the first bottom surface, wherein the first bottom surface presses from above on an adjoining region of the flange portion, the adjoining region being disposed radially outside of the tubular side wall, and wherein a step height between the first bottom surface and the second bottom surface in an axial direction of the tubular side wall is substantially equal to or smaller than a height of the adjoining region of the flange portion in the axial direction.

8. The wind turbine of claim 1, wherein the wind turbine further comprises a plurality of bolts extending vertically through respective through holes in the adapter, and wherein a horizontal distance between two of the plurality of bolts is larger than about 4.25 m.

9. A system for mounting a tower to a foundation, the system comprising:

a tower base section comprising at a lower end a T-flange comprising an outer portion; and at least one adapter comprising:

a body comprising:

at least one through hole for an anchor bolt, a retaining portion defining a first bottom surface configured to be arranged on the outer portion of the T-flange, and a fastening portion extending radially outward from the retaining portion, the fastening portion defining a second bottom surface configured to be arranged on the foundation, wherein the retaining portion forms a shoulder configured to be arranged on the outer portion of the T-flange.

10. The system of claim 9, wherein the body is substantially ring-shaped or ring segment-shaped.

11. The system of claim 9, wherein the at least one through hole extends through the second bottom surface.

12. The system of claim 9, wherein the at least one through hole is arranged between the first bottom surface and the second bottom surface.

13. The system of claim 9, wherein at least one of the first bottom surface and the second bottom surface is convex.

14. The system of claim 9, wherein the body comprises an outer radius which is larger than about 2.27 m.

15. The system of claim 9, wherein a step height between the first bottom surface and the second bottom surface in a direction of the through hole is smaller than a height of the outer portion in the direction of the through hole by a few mm up to about 1 cm.

16. The system of claim 9, further comprising a circumferential metal plate fastened to a body of the foundation and substantially extending to an upper surface of the foundation, and wherein the second bottom surface is configured to be arranged on the circumferential metal plate.

17. The wind turbine of claim 4, wherein at least one through hole extends through the fastening portion.

* * * * *